US006533144B2

(12) United States Patent
Davies et al.

(10) Patent No.: US 6,533,144 B2
(45) Date of Patent: Mar. 18, 2003

(54) FLUID DISPENSER

(75) Inventors: Jonathan Neil Davies, Surrey (GB); Holger Schueddekopf, Buxtehude (DE)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/778,167

(22) Filed: Feb. 7, 2001

(65) Prior Publication Data

US 2001/0052528 A1 Dec. 20, 2001

(30) Foreign Application Priority Data

Feb. 7, 2000 (GB) ..... 0002751

(51) Int. Cl.[7] ..... B67D 5/40
(52) U.S. Cl. ..... 222/153.13; 222/321.7
(58) Field of Search ..... 222/153.13, 321.1, 222/321.7, 383.1

(56) References Cited

U.S. PATENT DOCUMENTS 4,434,917 A 3/1984 Saito et al. ..... 222/383
5,405,057 A * 4/1995 Moore ..... 222/153.13
5,829,645 A * 11/1998 Hennemann ..... 222/321.1

FOREIGN PATENT DOCUMENTS

| | | | |
|---|---|---|---|
| EP | 0 461 891 A2 | 12/1991 | |
| EP | 567369 | * 10/1993 | ..... 222/321.1 |
| GB | 648 490 | 1/1951 | |
| GB | 1 570 101 | 6/1980 | |

OTHER PUBLICATIONS

GB Patent Office Search Report No. GB 0002751.6 dated Apr. 5, 2000.

* cited by examiner

*Primary Examiner*—Joseph A. Kaufman
(74) *Attorney, Agent, or Firm*—Alan A. Bornstein

(57) ABSTRACT

A fluid dispenser 1 according to the invention comprises a container bottle 2 having a neck portion 3 and a body portion 4. A product 5 such as liquid soap is contained within the container body 4. A pump 6, extending into the body 4, is operated by the depression of a pump actuator head 7 mounted on the neck portion 3. A support plate 8 comprising a collar portion 9 and a projecting plate portion 10 is mounted on the neck portion 3 of the container 2, below the head 7.

9 Claims, 2 Drawing Sheets

FLUID DISPENSER

BACKGROUND OF THE INVENTION

The invention relates to fluid dispensers, and particularly though not exclusively to dispensers for liquid soaps and similar products.

Liquid soaps and products of a similar type are sold to consumers in a variety of different types of container. The soap or other product is typically contained in a container having a pump actuator head that is depressed to dispense the product onto the hand of the consumer. The containers can be a wide variety of shapes, and there are different actuator heads and pumping means available, but the dispensers all operate on similar principles, with the actuator head being depressed, the product being drawn up a feed pipe and dispensed through a nozzle in the actuator head onto the user's hand.

The dispensers are generally simple and convenient to use, but can cause problems when a consumer tries to operate the actuator head and dispense the contents with only one hand, with the other hand being possibly unavailable to provide support to the dispenser, possibly because of stickiness, greasiness or other problems, or simply where the user simply desires to use only one hand for dispensing the composition. In particular, many of the designs of dispenser container are not sufficiently stable, especially when they have been emptied to a significant extent, to enable a consumer to operate the actuator head without using the other hand to support the dispenser to prevent it tipping or moving during operation of the actuator head.

An advantage of the invention is to allow more effective one-handed operation of a fluid dispenser, in particular a pump actuated fluid dispenser.

The invention provides a manually actuated fluid dispenser comprising:

- a container bottle having a neck portion;
- a pump;
- a pump actuator head mounted on the container neck portion; and
- a support plate located adjacent the container neck portion below the pump actuator head.

Users generally operate fluid dispensers with the thumb or one or more fingers on one hand on the pump actuator head, whilst usually having to catch the dispensed fluid with the other hand, and optionally holding the fluid dispenser steady with the fingers of one or both hands. In the arrangement of the invention, the user may conveniently position one or more fingers or at least part of the palm of the hand to catch dispensed fluid and co-operate with operation of the pump actuator by the thumb of the same hand. In doing this, the dispenser is steadied by virtue of being effectively gripped by the compressive action of the thumb on the pump actuator, and the fingers and/or palm of the same hand on the support plate.

Alternatively although less preferred, the thumb may co-operate with operation by one or more fingers, the dispensed fluid being caught on part of the thumb or hand, with the dispenser being generally steadied in a similar manner. In either case, part of the hand or one or more of the fingers is employed under the support plate to hold the dispenser steady as the pump is actuated to dispense the product onto the same hand that the user is using to operate the pump.

The support plate may be advantageously formed from injection moulded plastics material.

Preferably the support plate comprises a separate collar portion which can be located adjacent or actually on the neck portion of the container, which has depending therefrom a projecting support plate portion. Advantageously the collar portion and the projecting plate portion are integrally formed together. According to a further envisaged embodiment though, the support plate may be integrally moulded with the container and located on or closely adjacent the neck portion of the container bottle, using for example conventional blow moulding techniques which are used to manufacture the container bottle itself. The support plate may conveniently be located within about 5 cm, more conveniently within about 3 cm of the bottom of the neck, i.e. where the neck of the container joins the container bottle.

In many embodiments the neck of the container will be a distinct and readily identifiable part of the container, often at or near the top of the container when it is stood in its normal manner on a horizontal surface. Often it takes the form of a substantially tubular opening through which the contents of the container may be dosed into and dispensed from the container. However in the absence of such a readily identifiable (e.g. tubular) portion, the neck of the container can be regarded as the opening through which the contents of the container are dosed and dispensed.

Preferably the projecting plate portion is sufficiently rigid so that it does not bend under the co-operating action of the fingers and thumb of the user.

Where the support plate is provided as part of a separate collar, preferably the collar is mounted on the neck portion of the container so that it does not move relative to the container bottle when the user operates the actuator head. Conveniently the support plate depends from only a portion of the periphery of the neck, though embodiments are envisaged where the support plate may entirely surround the periphery of the neck.

The support plate may take any of a variety of configurations, and may for example have minimal (e.g. 3 mm or so) width. It need not necessarily be generally planar (though it may be in preferred embodiments), as embodiments are envisaged where it may comprise for example a gently curved, generally smooth, downwardly pointing hook or lip. It is however important that it fulfils its functional requirements, which is to facilitate a compressive action between the part of the hand actuating the dispenser and the part of the hand onto which the dispensed substance is dispensed, whilst simultaneously allowing the dispenser to be steadied.

Typically the pump actuator head comprises an internal mounting recess for mounting the head on the neck portion, the recess having a region towards its lower edge having a diameter greater than the external diameter of the collar portion of the support plate such that the pump actuator head moves down over the collar when the head is depressed to dispense the product in the container bottle. However the alternative embodiment is specifically envisaged, in which on dispensing the pump actuator head moves within the collar on depression of the actuator head.

Preferably the support plate is mounted on the container in a position which is in general alignment with the pump actuator head when it is in the operable position. Many commercially available dispenser pumps operate in such a manner that the pump means, which in use is located inside the dispensing container (or the container neck), has its relative position releasably secured during assembly and manufacture of the commercial product. In use, to prime the pump for operation, it is necessary to release and reconfigure the pump actuator relative to the pump means. This may typically be done by depressing or raising the pump actuator from a first position relative to the secured pump means, and twisting the pump actuator by e.g. one quarter or one half of a turn to a second position. In the first position the pump cannot be depressed or actuated, whilst in the second it can.

According to this facet, an added advantage of the invention may lie in that the positioning of the support plate, which may provide an indication to the user of whether the actuator head is in an open position or a closed position. Particularly, when the dispenser is in the operable or open position, the dispenser head and the support plate may be in general alignment, whereas when the dispenser is in the inoperable or closed position, they are not. This can be used to simplify opening of the container, as the user does not have to consult instructions or consider which way to rotate the dispenser head to prime the container for use, but simply to rotate it to generally align with the support plate.

In an alternative arrangement, the support plate may take the form of a plurality (e.g. two, or possibly more) projecting plate portions on generally opposing sides of the collar. This is particularly advantageous if the user needs to apply a greater amount of force than usual to the actuator head, or if the container is small such that the user can hold it in one hand and dispense the product at the same time. In this embodiment, the container contents may be dispensed by engaging the first two fingers of a given hand underneath the projecting support plate portions on either side of the collar, and the thumb may then be used to depress the actuator head and dispense the contents.

The invention will now be further described, by way of example only, with reference to the accompanying drawings, of which:

DETAILED DESCRIPTION OF THE DRAWINGS

Figure 1:
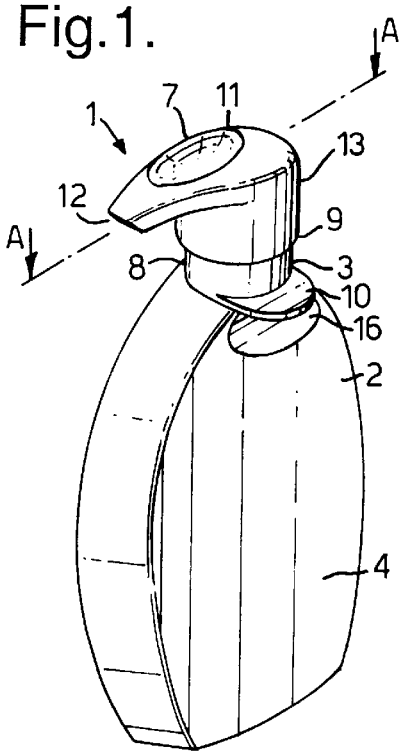
FIG. 1 shows a perspective view of a dispenser according to the invention with the actuator head in a closed position.
Figure 2:
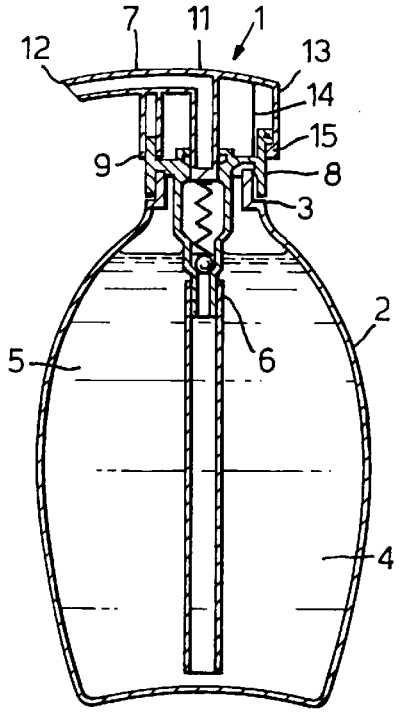
FIG. 2 shows a cross-sectional view of the dispenser of FIG. 1 along the line A—A.

As shown in the figures, a dispenser 1 according to the invention comprises a container bottle 2 having a neck portion 3 and a body portion 4. A liquid product 5 such as liquid soap is contained within the container body 4. A pump 6 extends into the container body portion 4, is operated by the depression of a pump actuator head 7, and has depending therefrom a diptube which extends to the bottom of body portion 4, through which liquid product 5 to be dispensed may pass. Pump 6 is secured relative to neck portion 3 by any convenient means.

Mounted on the neck portion 3 of the container 2, below the head 7 is a support plate 8 comprising a collar portion 9 and a projecting plate portion 10. The projecting plate portion 10 is rigid, and the support plate 8 is securely mounted via the collar portion 9 on the neck portion 3 of the container 2 so that is does not move relative to the container bottle 2 when the actuator head 7 is depressed, even if it is grasped e.g. in the manner described herein in depressing head 7 and dispensing the liquid product.

Figure 5:
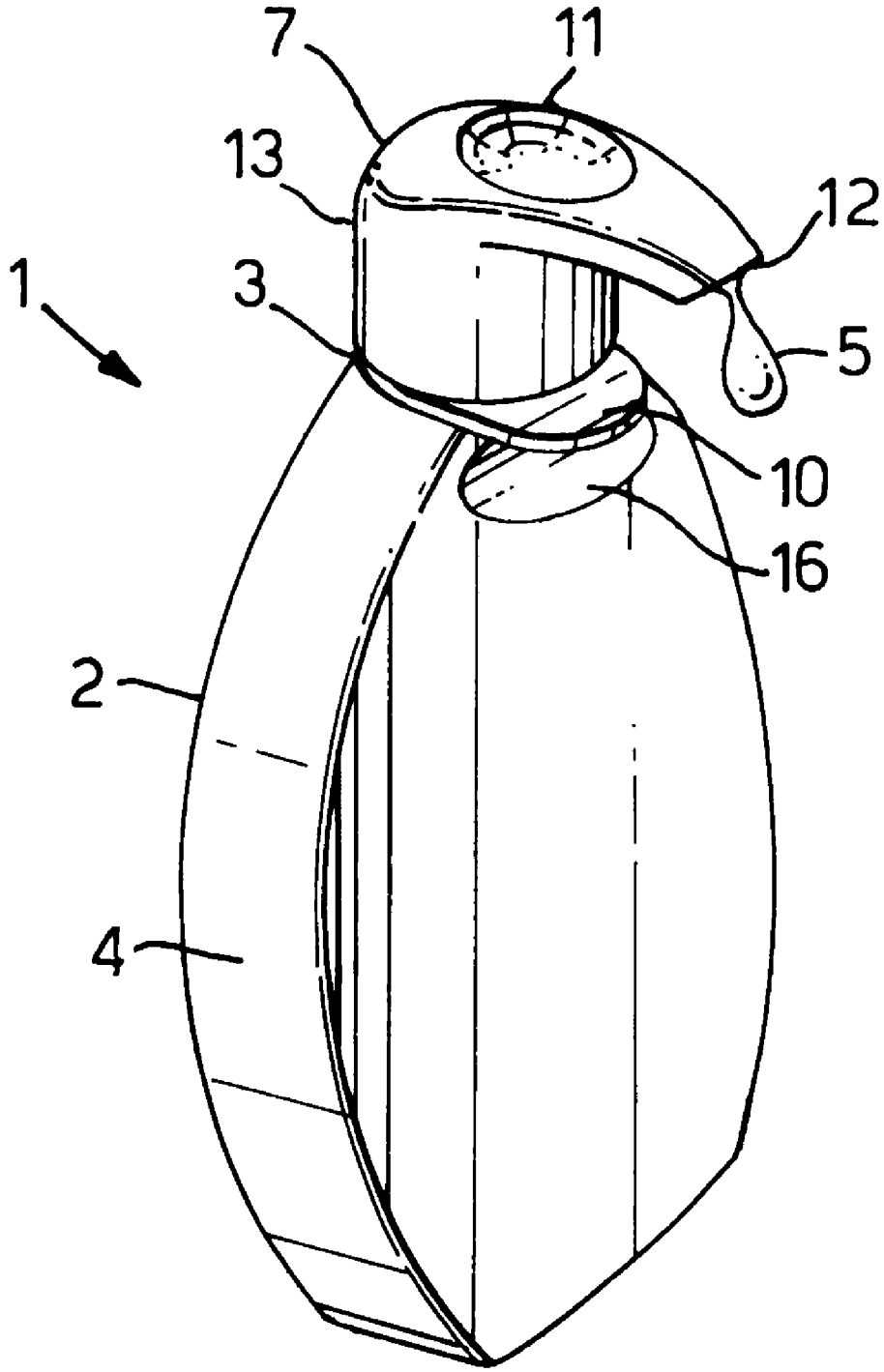
FIG. 5 shows a perspective view of the dispenser of FIG. 4 with the head depressed to dispense a product.

The pump actuator head 7 comprises a depressor face 11 that in use is typically contacted by a user's thumb to depress the head 7 to dispense product 5, a nozzle 12 through which product 5 is dispensed, and a mounting portion 13 having an internal mounting recess 14 for mounting the head 7 on the neck portion 3. The recess 14 has a region 15 having a diameter greater than the external diameter of the collar portion 9 of the support plate 8 such that the pump actuator head 7 can move down over the collar 9 when the head 7 is depressed to dispense the product 5 in the container 2, as shown in FIG. 5.

Figure 3:
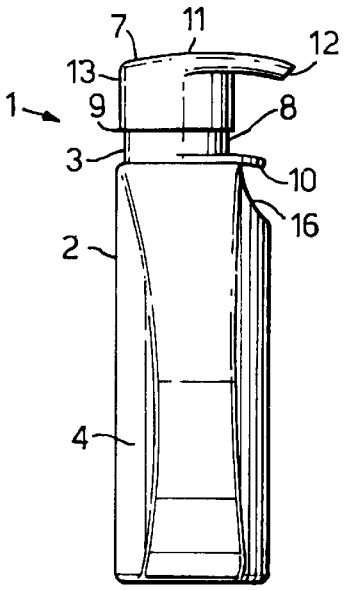
FIG. 3 shows a side view of the dispenser of FIG. 1.
Figure 4:
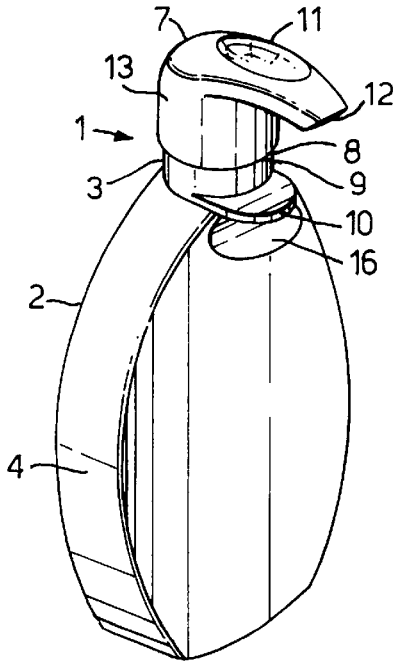
FIG. 4 shows a perspective view of the dispenser according to the invention with the actuator head in an open position.

The projecting plate portion 10 of the support plate 8 can be used to provide an indication to a user of whether the actuator head 7 is in an open or operable position, or a closed or inoperable position, and in which direction it is necessary to rotate the head 7 to move it from a closed to an open position. FIG. 1 shows the head 7 in a closed position. To move the head 7 to an open position such that the product 5 can be dispensed, it is unlocked and rotated in the direction of the projecting plate portion 10, as shown in FIGS. 3, 4 and 5, optionally in conjunction with at least partially raising or depressing the actuator head 7 relative to the container bottle 2. This is easy for a user to determine, without having to examine the top of the head 7 or the back of the container for instructions on which way to rotate the head 7. Such instructions can be difficult to decipher, particularly for those with poor eyesight.

The body portion 4 of the container also preferably has located adjacent and underneath the projecting plate 10 a depression 16, which depression 16 is conveniently integrally moulded with the container body 4 in general alignment with projecting plate 10. Depression 16 may act to accommodate a finger of the user, typically the index finger when the user is dispensing the contents of the container using a thumb to depress the actuator, and may enable the user to obtain better purchase on the underside of the projecting plate 10 during dispensing.

In use, the dispenser of the invention can readily be operated with one hand by a user, with the support plate enabling the user to use the thumb and finger or fingers of one hand to operate the pump and stabilise the dispenser while dispensing the product onto the same hand.

What is claimed is:

1. A manually actuated fluid dispenser comprising:

a container bottle having a neck portion;

a pump;

a pump actuator head mounted on the container neck portion, the pump actuator head having an operable position and an inoperable position; and a support plate comprising a projecting plate located on the container neck portion below the pump actuator head, wherein the support plate is mounted on the container with the projecting plate in a position below the operable position of the pump actuator head; whereby a product contained in the container bottle is dispensed in the direction of the projecting plate and into a hand of a user, the same hand which operates the pump actuator head and engages the projecting plate.

2. A fluid dispenser according to claim 1 wherein the support plate is formed from injection moulded plastics material.

3. A fluid dispenser according to claim 1 wherein the support plate comprises a collar portion for mounting on the neck portion of the container and a projecting plate portion.

4. A fluid dispenser according to claim 3 wherein the collar portion and the projecting plate portion are integrally formed together.

5. A fluid dispenser according to claim 1 wherein the support plate is rigid.

6. A fluid dispenser according to claim 1 wherein the collar of the support plate is mounted on the neck portion of the container so that it does not move relative to the container bottle when the user operates the actuator head.

7. A fluid dispenser according to claim 1 wherein the pump actuator head comprises an internal mounting recess for mounting the head on the neck portion, the recess having a region towards its lower edge having a diameter greater than the external diameter of the collar portion of the support plate such that the pump actuator head moves down over the collar when the head is depressed to dispense the product in the container.

8. A fluid dispenser according to claim 1 wherein the support plate has a second projecting plate portion on the opposite side of the collar to the first projecting plate portion.

9. A fluid dispenser according to claim 1, wherein the container bottle has located therein adjacent the neck portion a depression.

* * * * *